US005576069A

United States Patent [19]

Chen et al.

[11] Patent Number: 5,576,069

[45] Date of Patent: Nov. 19, 1996

[54] LASER REMELTING PROCESS FOR PLASMA-SPRAYED ZIRCONIA COATING

[76] Inventors: Chun Chen, 2nd Floor, 9 Lane 111, Sec. 1, Hangchow S. Road, 100 Taipei; Wen-Cheng Wei, 8th Floor, 33 Lane 175, Sec. 1, Chien-Kuo S. Road, 106 Taipei; Kai-Jai Chang, 2 Ta-Pu-Mei, Ta-Li Chen, 622 Chiayi Hsien, all of Taiwan

[21] Appl. No.: 437,625

[22] Filed: May 9, 1995

[51] Int. Cl.[6] ..... C23C 4/10

[52] U.S. Cl. ..... 427/454; 427/554; 427/556; 427/350; 427/553; 427/419.3

[58] Field of Search ..... 427/554, 556, 427/453, 454, 350, 553, 419.3

[56] References Cited

U.S. PATENT DOCUMENTS

| | | | |
|---|---|---|---|
| 3,789,096 | 1/1974 | Church et al. | 106/66 |
| 4,377,371 | 3/1983 | Wisander et al. | 415/174 |
| 4,537,793 | 8/1985 | Kehrer et al. | 427/554 |
| 4,675,204 | 6/1987 | Nicoll et al. | 427/554 |
| 4,988,538 | 1/1991 | Horvei et al. | 427/554 |

OTHER PUBLICATIONS

Jasim, et al. "Pulsed Laser Sealing of Plasma–sprayed Layers of 8 wt % Yttria Stabilized Zirconia," *Journal of Materials Science*, 27:3903–3910 (1992) (no month date).

Jasim, et al. "Operating Regimes for Laser Surface Engineering of Ceramics," *Journal of Materials Science*, 27:1937–1946 (1992) (no month date).

Jasim, et al. "Laser Sealing of Plasma–Sprayed Calcia–Stabilized Zirconia," *Journal of Materials Science Letters*, 7:1307–1309 (1988) (no month date).

*Primary Examiner*—Katherine Bareford
*Attorney, Agent, or Firm*—Fish & Richardson, P.C.

[57] ABSTRACT

A laser remelting process is provided to fabricate a metal article with a thermal-barrier ceramic top coat having improved oxidation resistance and surface properties. The process includes the combination of following two laser remelting treatments which are conducted while the metal substrate is at temperatures above 850° C.: (1) Firstly, remelt a plasma-sprayed zirconia coating which is applied on a metal article by means of a high-power laser. The process step is assigned as a "primary laser remelting" step; (2) coat the treated surface with a thin layer of zirconia powder, then remelt the surface of the article while the metal substrate is preheated. The step is assigned as a "secondary laser remelting" step. The treated articles are well-suited for such applications as turbine blades and engine parts operated at high temperatures and corrosive environment.

23 Claims, 2 Drawing Sheets

LASER REMELTING PROCESS FOR PLASMA-SPRAYED ZIRCONIA COATING

BACKGROUND OF THE INVENTION

1. Field of the Invention

The present invention relates to a laser remelting process to modify surface properties of a zirconia coating on a metal article.

2. The State of the Art

For the purpose of raising working temperature and operation efficiency at high temperatures, an engine part needs a surface coating acting as a thermal barrier to prolong its life time and performance. Plasma spraying of abrasive and refractory ceramic materials on a metal substrate is one of the techniques to apply a coating layer on engine parts.

Sim et al. ("Superalloy II", John Wiley & Sons, Inc., 1987) have divided thermal barrier coatings (abbreviated as "TBCs") into two categories: one is diffusional coating, e.g. pack cementation or chemical vapor deposition (abbreviated as "CVD"); the other is overlay coating, e.g. plasma spray. It would be beneficial to operate the engine part at higher temperature. The ceramic top coating on a metal part is necessary for preventing the metal substrate from overheating. The effects of lowering substrate temperature depend upon the thickness of the coating and the thermal conductivity of its top and the coatings. The greater the temperature difference ($\delta T$) between the environment and the engine part is achieved, the better the protection and efficiency that are provided. As a consequence, the amount of inlet cooling gas can be reduced and operation efficiency is improved greatly.

The preparation of TBCs known to the artisan is conducted with a high temperature (5000° C. to 30000° C.) air plasma touch. Ceramic powder is melted in the plasma and projected onto a metal article. The partially-melted or fully melted ceramic particles are quenched and adhere to the surface of the article. However, the mechanical bonding of the coating layer deteriorates due to the thermal expansion mismatch between the ceramic layer and the metal matrix. Large interfacial stresses are generated. The stresses can be reduced by applying a bond coat (e.g. MCrAlY metal alloy layer, reported by G. W. Goward, Materials Sci. & Tech., 2[3] (1986) 194–200) between the ceramic top coat and the metal substrate. However, the structure of the TBCs is still porous and allows oxygen to pass through to the metal bond coat. The porous TBC spalls when the multilayer structure is exposed to oxidizing and corrosive environment. If the bond coat can be shielded from the corrosive media, including oxygen, the lifetime of TBCs can be effectively extended. Therefore, many modifications have been proposed and implemented, and have proven to be effective to some extent, for example: pre-oxidation of the bond coat; pre-aluminization of the bond coat (Wei-Cheng Lih, Ph.D. Thesis, National Cheng-Kung University, Tainan, Taiwan, R.O.C., 1992); application of denser ceramic top coat by using low pressure plasma spray (LPPS); and laser sealing of ceramic top coat (K. Mohammed Jasim, R. D. Rawlings, and D. R. F. West, J. Mat. Sci., 27 (1992) pp. 3903–3910 or A. Smurov and Y. U. Krivonogov, J. Mat. Sci., 27 (1992) pp. 4523–2530), etc.

The life of TBCs can be extended by blocking corrosive media and oxygen from entering the metal bond coat. In general, sealing the porous top coat (e.g. zirconia layer) by a laser is often selected. It is called laser glazing, laser sealing, or laser remelting in this field.. The surface after laser remelting is smoother and less porous than that of an as-sprayed top coat.

However, the laser remelting process has some disadvantages. When the surface is melted by a laser beam, the porous top layer is densified and becomes a liquid. The melted surface quickly solidifies as the laser beam passes. The solidification process starts from the surface and the liquid layer grows a great amount of columnar ceramic grains. This rapid cooling step results in appreciable thermal stresses, and it induces surface cracking and depressions in the top coat.

SUMMARY OF THE INVENTION

In view of the foregoing state of the art, it would be beneficial to provide a different laser remelting process which could offer an improvement on the structure and oxidation property of the coating layers. A high power $CO_2$ laser is selected in this invention for its capability to heat up ceramic material as high as 6000° C. in seconds. Normally, the thickness of the laser-treated layer is optimized between 20 to 100 μm for better performance in thermal cycling tests and for smaller thermal stress.

Following the step, of primary laser remelting, a thin layer ceramic powder is uniformly applied on the primary laser treated surface. Then secondary remelting of the top coat is performed when the substrate is preheated above 850° C.

The invention has the following advantages over the traditional laser-glazing processes:

1. Limit the diffusion path of oxygen gas and corrosive media: For the samples treated by a traditional laser glazing, the width of their surface cracks are about 20 to 40 μm, and some depressions are produced concurrently. The depressions are the result of the shrinkage of large air bubbles in the top coat, and are the concentration points of thermal stresses. They often act as a fracture origin. However, the cracks and depressions, if treated with the process of the invention, will be refilled with ceramic material, and the number of depressions will be reduced dramatically.

2. Increase the density of ceramic top coat and reduce the number of air bubbles within the laser treated zone: It was inevitable to have the depressions after primary laser glazing. Under the processing conditions of same laser power density, higher power or faster traverse speed of the laser beam was effective to reduce the number of the depressions. But the gas bubbles would form in the laser treated zone (as the bubbles 4 illustrated in FIGS. 1, 2 and 3). If additional steps as revealed in this invention are taken, there are no depressions found on the surface, and the number of the bubbles inside the zone is minimized.

3. Separate surface cracks by the secondary laser remelting treatment. The diffusion path of corrosive gas is terminated. Accordingly, the service life of coated article is extended.

DESCRIPTION OF THE PREFERRED EMBODIMENTS

Figure 1:
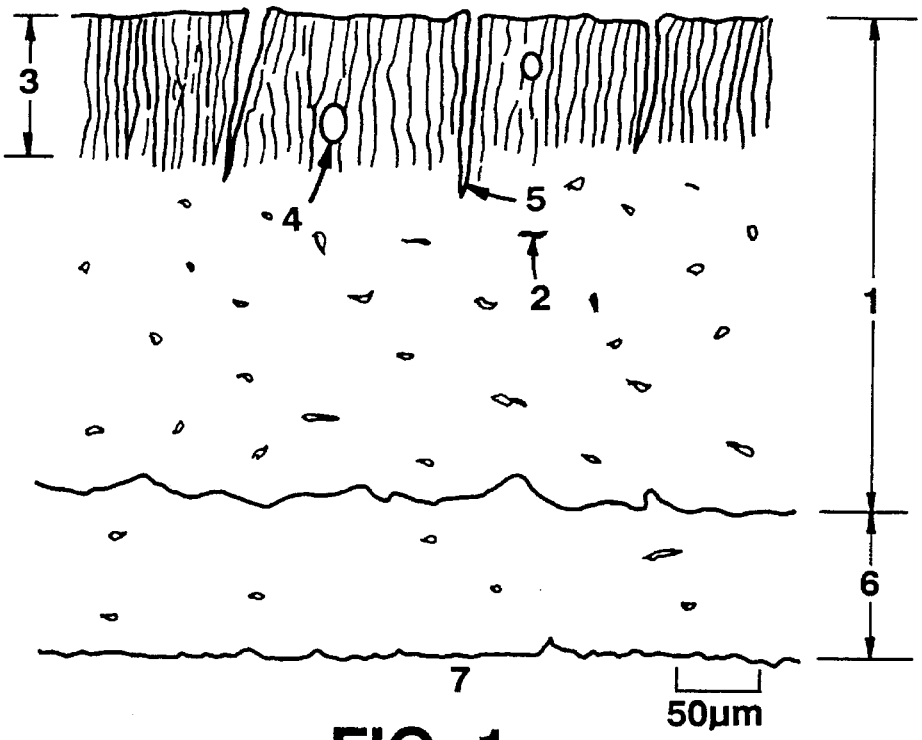
FIG. 1 is a schematic diagram of the cross section of a TBCs specimen after primary laser remelting (called "LA1").

Referring to FIGS. 1, a plasma sprayed ceramic top coating 1 is formed on top of a bond coat 6 on a metal substrate 7. The plasma sprayed coating 1 has pores 2. A surface zone 3 of the plasma sprayed coating 1 has been once laser remelted to a depth of 70–100 μm. The laser remelted zone 3 has defects, including gas bubbles 4 and cracks 5. This specimen is referred to as LA1.

Figure 2:
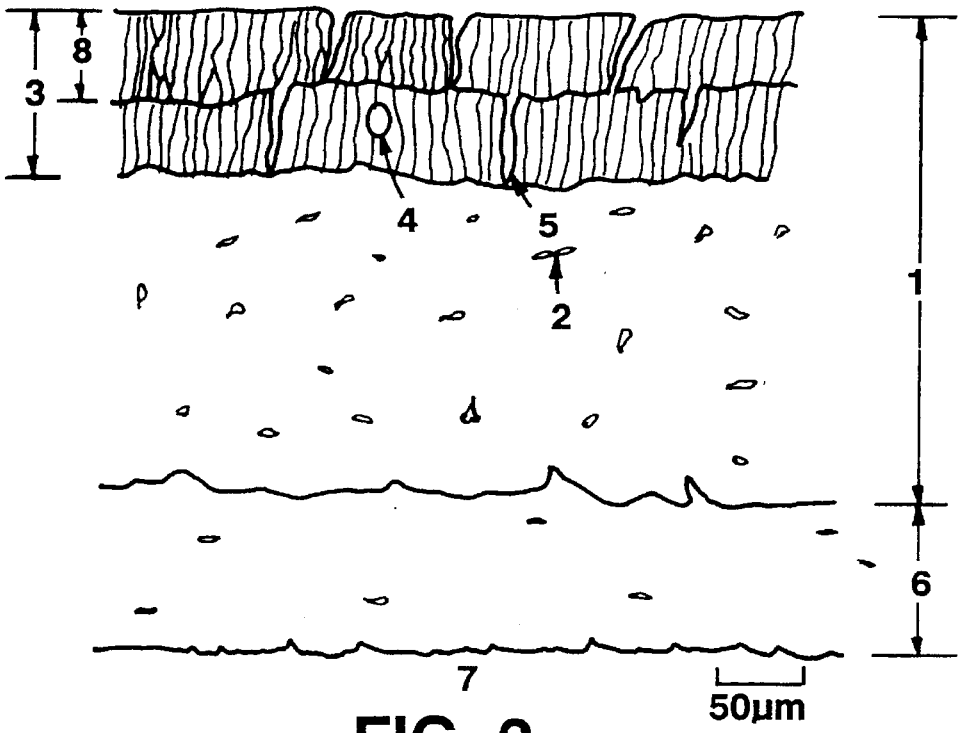
FIG. 2 is a schematic diagram of the cross section of the previous specimen (LA1) but with an additional laser remelting step (called LA2).

Referring to FIG. 2, part of the laser remelted zone 3 has been laser remelted again, this time to a depth of 40 to 50 μm, forming a second laser remelted zone 8 in an upper portion of zone 3. This specimen is referred to as LA2.

Figure 3:
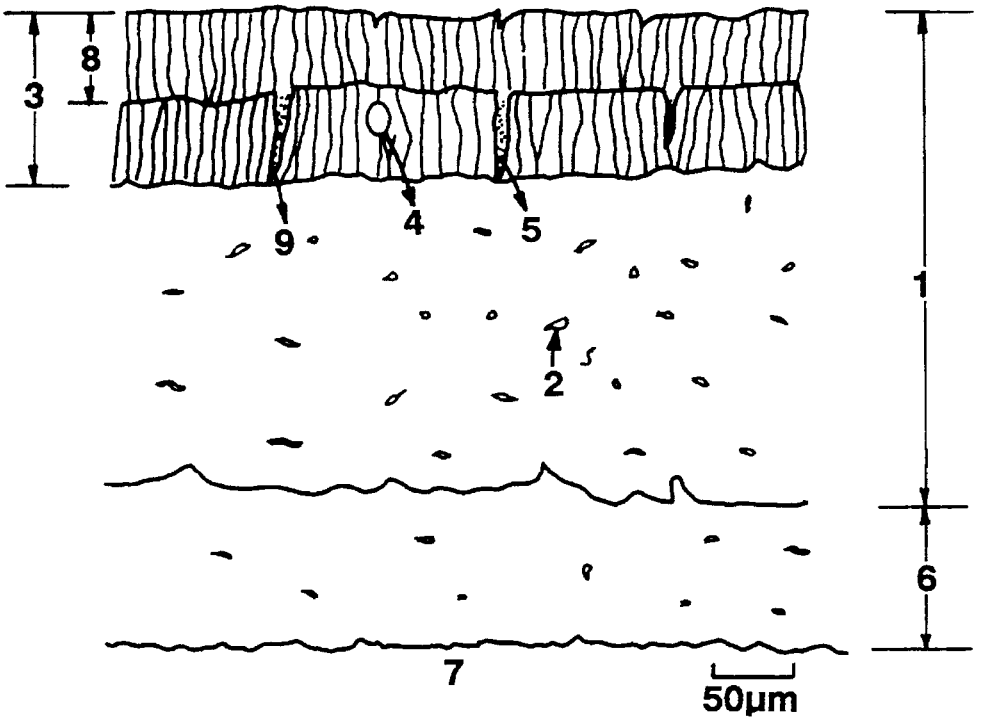
FIG. 3 is a schematic diagram of the cross section of a LA1 after it has been evenly painted with a layer of fine ceramic powder and after it has then undergone a secondary laser remelting step (this sample is called "LAZ2").

Referring to FIG. 3, a sample LA1, as illustrated in FIG. 1, has been evenly painted with a layer of fine ceramic powder 9 and the remelted during a subsequent secondary laser remelting step. The fine ceramic powder 9 fills the cracks 5. There will be no cracks across an interface between the laser remelted and secondary laser remelted zone 8. The ceramic powder 9 in the interface is normally melted while treated with a high power laser beam. The possible diffusion paths (e.g. cracks 5) are blocked after the secondary remelting step.

Example 1

Commercially available austenite 304 stainless steel was selected as a substrate material. There are two types of substrate. One is a plate-shape sample with dimensions 100 mm×30 mm×3 mm. The other is a rod-shaped sample with the diameter and length of 16 mm and 300 mm, respectively. Before plasma spraying, the sample was first sand-blasted with 40 mesh alumina particles. Air pressure for blasting was kept at 3 kg/cm$^2$. Then the sample was cleaned ultrasonically in a dry alcohol bath. The clean and dried surface then was plasma-sprayed with an alloy powder (Ni-164/Ni-211), which was obtained from Union Carbide Co. in a composition Ni-22Cr-10Al-1Y (wt %).

The spraying parameters were selected as follows:

Spraying current: 600 (Amp.)

Spraying voltage: 66.3 (Volt)

Primary gas: Ar (flowing rate: 39 liter/min)

Secondary gas: $H_2$ (flowing rate: 5.6 liter/min)

Spraying distance: 130 (mm)

Figure 4:
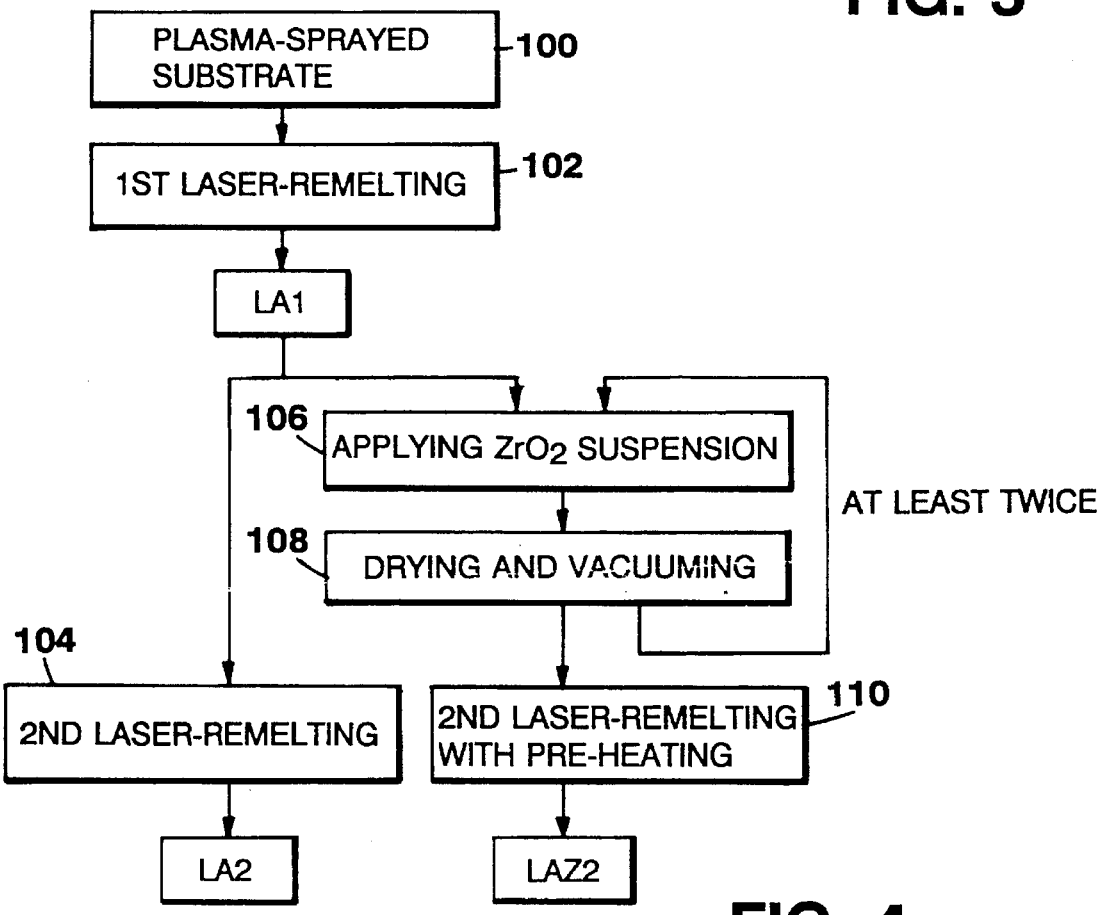
FIG. 4 is a flow chart of the laser remelting processes described herein.

The bond coat was sprayed and followed by a high temperature treatment (normally called "diffusion bonding treatment") to even the composition and release the stresses of the coating (step 100—referring to FIG. 4).

The ceramic powder for the top-coating was produced by Metco Co., USA. The ceramic composition is $ZrO_2$-8 wt% $Y_2O_3$. The thickness of the bond coat and top coat was between 100 to 120 μm and 300±20 μm, respectively. The above-mentioned sample was assigned "PSI".

The power density of linear laser beam was in the range of $10^1$ to $10^2$ W/mm$^2$. The power of laser remelting (step 102) was 2000 Watts and the traverse speed of the laser beam was 2000 mm/min. We measured the depth of laser remelting to be 70 to 100 μm. The sample through the above-mentioned treatment was called "LA1" (see FIG. 1 ) If LA1 was retreated once by laser remelting (step 104), then the sample was called "LA2" (see FIG. 2). In this invention, the power of secondary laser remelting was lower than the primary remelting.

In order to minimize the number of surface cracks and depressions, the substrate of the sample was preheated during laser treatment. The plate-shaped sample was preheated by a hot plate. The rod-shaped sample was preheated by an electrical box furnace. The samples can be heated up to 950° C. Usually, 10-minute holding is required to get an uniform temperature distribution on the sample surface before laser remelting. The samples after laser treatment were cooled in the furnace.

From observations of the surface of the LA1 sample, the microstructure reveals that the opening of cracks is about 10 μm. It is narrower than that of the cracks observed on similar samples without preheating. In addition, to reduce the opening of the cracks, the preheating of the metal substrate enhances the bonding between the laser treated zone and top coat.

A positive effect on the reduction of crack opening is observed if zirconia powder was applied on LA2 before secondary laser remelting. The crack opening of LA2 is in a range of 40 to 50 μm and the bonding is poor at the interface. Therefore, the remelting process is not feasible unless additional zirconia powder is applied.

A zirconia slurry or suspension was prepared by using a yttria-doped zirconia powder having an average particle size of about 0.5 μm and with a maximum particle size that is less than 5 μm (TZ-4Y, Toyo Soda Manufacturing Co., Ltd., Tokyo, Japan). In general, the zirconia powder should have particle sizes that are smaller than the openings in the surface flaws (e.g. cracks) on the ceramic coating after the first remelting step. Ceramic powder (including zirconia) typically shows a fairly wide distribution in size. With regard to the specific powder described above, the 5 μm particle size is smaller than the estimated size of the openings of the surface flaws. The powder is uniformly dispersed in the slurry.

The slurry was painted uniformly on the surface of LA1 (step 106), and the sample was left in a vacuum chamber (step 108). The painting and vacuuming procedures were repeated at least 2 times, to make sure that the slurry had flowed and filled the space in surface cracks. Then the dried LA1 was subjected to secondary laser remelting (step 110). The power of the laser beam was reduced to 1000 Watts and the traverse speed of the beam was 2000 mm/min. The specimen treated by the above-mentioned procedures was called "LAZ2" (see FIG. 3).

By comparing LA2 and LAZ2, we concluded that the additional zirconia layer can prevent peeling-off of the top coat and improve the bonding between layers. Besides, it also increases the degree of gas sealing of the surface layer. Therefore, it is important that a uniform zirconia ceramic powder is sprayed before secondary remelting is performed.

Example 2

A rod-shaped sample containing two different laser remelting zones, PS and LA1, was subjected to an oxidation test. The width of each laser treated zone was 24 mm, and the rest of the specimen was coated with as-sprayed zirconia layer. The sample was tested in an electrical furnace in which it was directly exposed to hot air for 60 hours or longer,. The temperature of the furnace was controlled within the range of 1200±5° C.

After the test, the zone LA1 was still bonding well, but the zone PS had debonded. The reason for failure of the PS is identified to be a serious oxidation of its bond coat. This test shows the evidence that the remelting process provided by this invention can improve the oxidation resistance of a plasma-sprayed metal article.

Example 3

A sample consisting of two different laser remelting zones (i.e., LA1 and LAZ2) was subject to the similar oxidation test as example 2. The sample was checked visually every three hours. The test was terminated when the surface of the sample showed peeling-off, and was defined as a "failure".

The region of LA1 became a source of failure. The substrate beneath the ceramic layer LA1 oxidized. However, there was no failure found in the LAZ2 zone. According to the test results, the process of the invention can provide an appropriate ceramic protection for a metal substrate.

The foregoing disclosure of specific embodiments is meant to illustrate the present invention and is not meant to be limiting. Various additions and modifications may become manifest to the skilled artisan upon reviewing this specification, which changes are meant to be within the scope and spirit of the present invention as defined by the following claims. For example, the step of applying a ceramic suspension can be performed by spraying the ceramic suspension onto the remelted ceramic coating. In addition, the preheating steps can be performed by resistance heating, laser-beam heating, infrared heating, gas-combustion heating, plasma heating, or any combination thereof.

What is claimed is:

1. A laser remelting process for improving surface properties of an article having a plasma-sprayed ceramic coating, said process comprising:

laser-remelting the ceramic coating on the article;

after laser-remelting, applying a ceramic suspension onto the remelted ceramic coating; and laser-remelting the ceramic coating after the ceramic suspension has been applied.

2. The laser remelting process of claim 1 further comprising preheating the coated article prior to performing the first mentioned laser-remelting step.

3. The laser remelting process of claim 2 further comprising preheating the coated article with the applied ceramic suspension prior to performing the second mentioned laser-remelting step.

4. The laser remelting process of claim 3 wherein the article is a metal article.

5. The laser remelting process of claim 4 wherein metal article is heated to a temperature that is above about 850° C. during the second mentioned preheating step.

6. The laser remelting process of claim 3 wherein the step of applying the ceramic suspension comprises uniformly dispersing a ceramic powder.

7. The laser remelting process of claim 6 wherein the step of applying a ceramic suspension comprises spraying the ceramic suspension onto the remelted ceramic coating.

8. The laser remelting process of claim 6 wherein the step of applying a ceramic suspension comprises painting the ceramic suspension onto the remelted ceramic coating.

9. The laser remelting process of claim 6 wherein the first mentioned laser-remelting step remelts the ceramic coating to a first depth and the second mentioned laser-remelting step remelts the ceramic coating to a second depth and wherein the second depth is less than the first depth.

10. The laser-remelting process of claim 6 wherein the preheating steps are performed using one or more techniques selected from a group of preheating techniques, said group of preheating techniques consisting of resistance heating, laser-beam heating, infrared heating, gas-combustion heating, plasma heating, and combined methods thereof.

11. The laser-remelting process of claim 6 wherein the ceramic suspension is made from a ceramic powder having the same composition as the plasma-sprayed coating.

12. The laser-remelting process of claim 6 wherein as a result of the first-mentioned laser-remelting step surface openings having a characteristic width appear and wherein the ceramic powder has a maximum particle size of less than said characteristic width.

13. The laser-remelting process of claim 6 wherein as a result of the first-mentioned laser-remelting step surface openings having a characteristic width appear and wherein the ceramic powder has an average particle size of less than said characteristic width.

14. The laser-remelting process of claim 6 wherein the ceramic powder has a maximum particle size of less than 5.0 μm.

15. The laser-remelting process of claim 14 wherein the ceramic powder has an average particle size of less than 0.5 μm.

16. The laser remelting process of claim 3 wherein the step of applying a ceramic suspension further comprises exposing the article with the applied ceramic suspension to vacuum conditions.

17. The laser remelting process of claim 16 further comprising drying the ceramic suspension prior to the step of laser-remelting the ceramic coating after the ceramic suspension has been applied.

18. The laser remelting process of claim 16 wherein the step of applying a ceramic suspension further comprises repeating the steps of uniformly applying and exposing to vacuum conditions.

19. The laser remelting process of claim 16 wherein the step of applying a ceramic suspension further comprises repeating the steps of uniformly applying and exposing to vacuum conditions at least two more times.

20. The laser-remelting process of claim 1, wherein the plasma-sprayed ceramic coating comprises zirconia.

21. The laser-remelting process of claim 20, wherein the plasma-sprayed ceramic coating comprises zirconia and yttria.

22. The laser-remelting process of claim 1, wherein the plasma-sprayed ceramic coating is formed on top of a bonding layer.

23. The laser-remelting process of claim 1, wherein the ceramic suspension enters into cracks formed in the plasma-sprayed ceramic coating after the first laser-remelting.

* * * * *

UNITED STATES PATENT AND TRADEMARK OFFICE

CERTIFICATE OF CORRECTION

PATENT NO. : 5,576,069

DATED : November 19, 1996

INVENTOR(S) : Chen, et al.

It is certified that error appears in the above-identified patent and that said Letters Patent is hereby corrected as shown below:

On the title page: Item [76]

Column 1, Line 8, replace "Kai-Jai Chang" with Kai-Chieh Chang.

Signed and Sealed this

Fourth Day of March, 1997

Bruce Lehman

*Attest:*

BRUCE LEHMAN

*Attesting Officer*

*Commissioner of Patents and Trademarks*